United States Patent [19]

Osika

[11] Patent Number: 4,937,407

[45] Date of Patent: Jun. 26, 1990

[54] LIQUID-RESISTANT SWITCH ASSEMBLY

[75] Inventor: Thomas Osika, Valparaiso, Ind.

[73] Assignee: McGill Manufacturing Co., Inc., Valparaiso, Ind.

[21] Appl. No.: 297,091

[22] Filed: Jan. 13, 1989

[51] Int. Cl.[5] ..... H01H 19/06

[52] U.S. Cl. ..... 200/302.3; 200/303; 200/339

[58] Field of Search ..... 200/302.3, 553, 556, 200/303, 334, DIG. 40

[56] References Cited

U.S. PATENT DOCUMENTS

| | | | |
|---|---|---|---|
| 3,408,463 | 10/1968 | Wanlass | 200/302.3 |
| 3,654,416 | 4/1972 | Cherry et al. | 200/302.3 |
| 3,668,938 | 6/1972 | Dimitry | 200/302.3 |
| 4,168,416 | 9/1979 | Josemans | 200/302.3 |
| 4,191,873 | 3/1980 | Woodard | 200/302.3 |
| 4,218,602 | 8/1980 | Creech | 200/302.3 |
| 4,242,551 | 12/1980 | Sorenson | 200/302.3 |
| 4,268,734 | 5/1981 | Sorenson | 200/302.3 |

FOREIGN PATENT DOCUMENTS

| | | | |
|---|---|---|---|
| 0657458 | 3/1938 | Fed. Rep. of Germany | 200/302.3 |
| 0811113 | 4/1937 | France | 200/302.3 |

*Primary Examiner*—Henry J. Recla
*Assistant Examiner*—Glenn T. Barrett
*Attorney, Agent, or Firm*—Leydig, Voit & Mayer

[57] ABSTRACT

A switch assembly having switch contacts located in a lower housing component and having a movable actuator located in an upper housing component and extending downwardly into the lower housing component through a sealing gasket located between the two housing components. The gasket prevents liquid spilled into the upper housing component from leaking into the lower housing component and shorting out the switch contacts. Drain openings are formed in the upper housing component and prevent the liquid from rising to a level where the liquid could leak past the sealing gasket. The actuator includes a manually operable button which is shaped to direct spilled liquid toward the drain openings. In addition, fin-like portions of the gasket extend beneath the drain openings to deflect the discharged liquid away from the outer side of the switch assembly.

11 Claims, 2 Drawing Sheets

LIQUID-RESISTANT SWITCH ASSEMBLY

BACKGROUND OF THE INVENTION

This invention relates generally to an electrical switch assembly and, more particularly, to a switch assembly which is operated in an environment where water or other liquid might be spilled on or otherwise come into contact with the switch assembly. One example of such a switch assembly is a switch assembly which is used in conjunction with a kitchen appliance such as a range.

A switch assembly of the type with which the present invention is concerned comprises a housing, switch contacts located in the housing, and a manually movable actuator for changing the electrical state of the switch contacts. Since the switch actuator must be accessible for manual operation, there is a possibility that the actuator might be exposed to water or other liquid. If the liquid is permitted to reach the switch contacts, the switch assembly may short out or otherwise be damaged. It thus is necessary to establish a seal between the housing and the switch actuator in an effort to prevent liquid from reaching the switch contacts. If the seal, however, has a flaw or if a substantial quantity of liquid accumulates around the seal, the seal may leak and allow liquid to reach the switch contacts.

SUMMARY OF THE INVENTION

The general aim of the present invention is to provide a new and improved liquid-resistant switch assembly in which liquid is prevented from accumulating in the seal area so as to reduce the likelihood of leakage through the seal.

A more detailed object of the invention is to achieve the foregoing by providing a switch assembly which is uniquely constructed to cause liquid in the vicinity of the seal area to drain harmlessly away from the assembly before the liquid has a chance to rise to a level where leakage could occur through the seal.

The invention also resides in the unique shape of the switch actuator to direct spilled liquid toward drain holes in the housing and in the novel provision of fins for deflecting liquid discharged out of the drain holes away from the outside of the switch assembly.

These and other objects and advantages of the invention will become more apparent from the following detailed description when taken in conjunction with the accompanying drawings.

DETAILED DESCRIPTION OF THE PREFERRED EMBODIMENT

Figure 1:
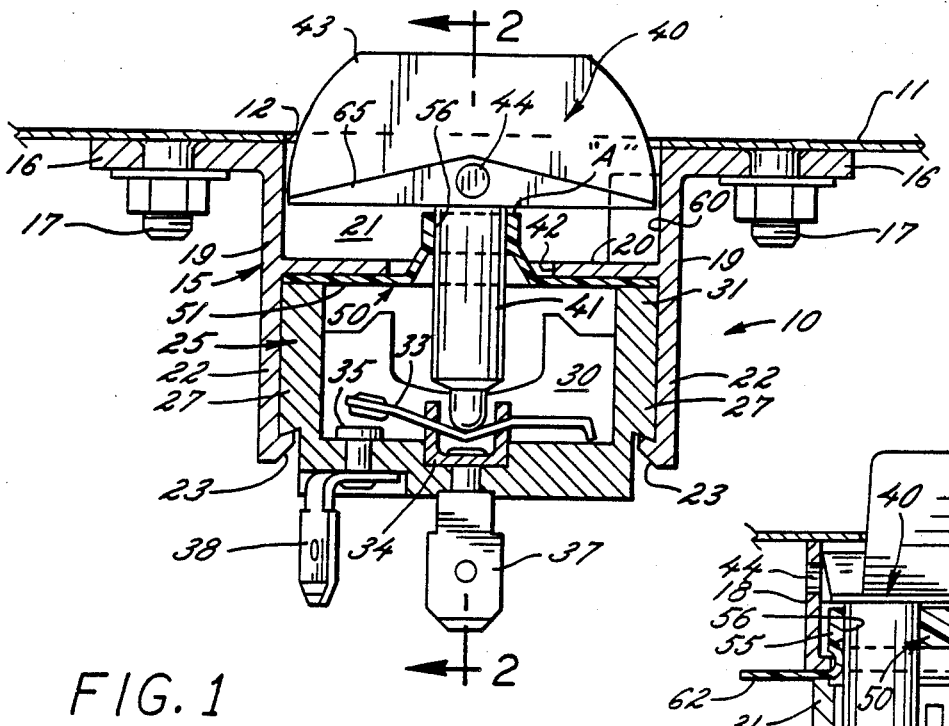
FIG. 1 is a cross-sectional view taken vertically through a new and improved liquid-resistant switch assembly incorporating the unique features of the present invention and shows the switch assembly installed in a typical appliance.

For purposes of illustration, the invention has been shown in the drawings as incorporated in a switch assembly 10 which, in the present instance, is used in conjunction with a kitchen range having a horizontal top panel 11 formed with a hole 12 for accommodating the switch assembly. The switch assembly includes a housing having an upper housing component 15 formed with a pair of oppositely extending mounting ears 16 which are secured to the underside of the panel 11 by threaded fasteners 17.

Figure 4:
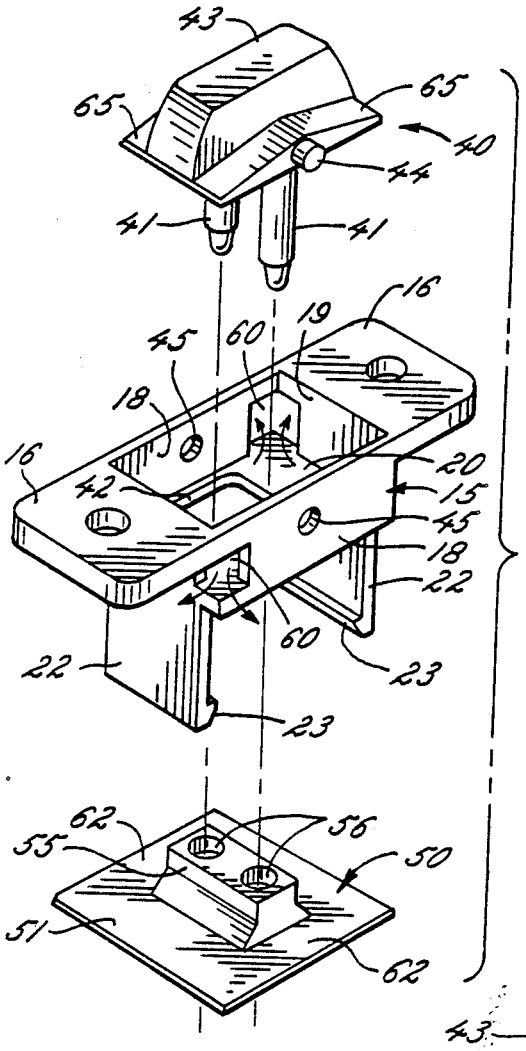
FIG. 4 is an exploded perspective view of three components of the switch assembly.
Figure 5:
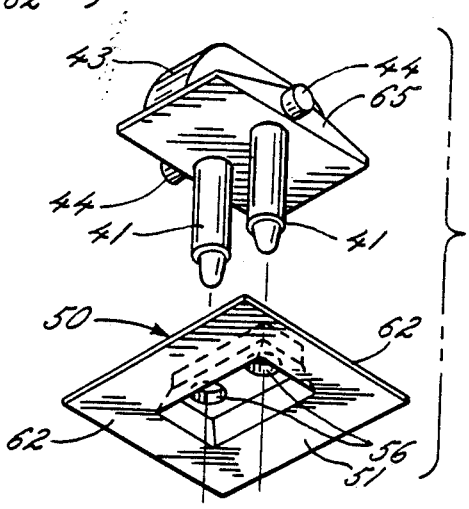
FIG. 5 is an exploded perspective view of two of the components illustrated in FIG. 4 but shows those components from a different angle.

The upper housing component 15 is made of plastic and includes two opposing side walls 18 (FIG. 4), two opposing end walls 19, and a horizontal bottom wall 20. The walls coact to define a generally rectangular and upwardly opening compartment 21 (FIG. 1) within the upper housing component 15. Two legs 22 are formed integrally with and project downwardly from the end walls 19 and their lower ends are formed with inturned flanges 23.

The switch assembly 10 further includes a lower housing component 25 having side walls 26, end walls 27 and a bottom wall 28. An upwardly opening and generally rectangular compartment 30 (FIG. 1) is defined within the lower housing component 25.

As shown in FIG. 1, the lower housing component 25 is disposed in the space between the legs 22 of the upper housing component 15 and its upper lip 31 is spaced just slightly below the bottom wall 20 of the upper housing component. The outer sides of the side walls 26 of the lower housing component 25 are undercut adjacent the bottom wall 20 and receive the flanges 23 on the lower ends of the legs 22 with a snap fit in order to hold the upper and lower housing components in assembled relation.

Figure 3:
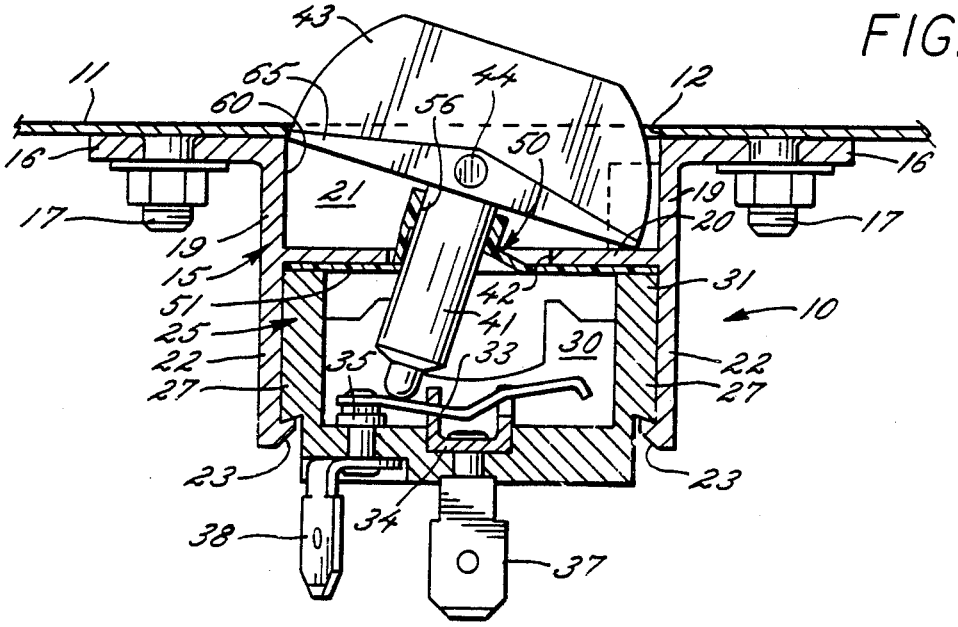
FIG. 3 is a view similar to FIG. 1 but shows the switch assembly in a different electrical state.

Disposed within the compartment 30 of the lower housing component 25 are two elongated switch contacts 33 which are supported on conductive mounting bases 34 to pivot between open positions shown in FIG. 1 and closed positions shown in FIG. 3. When the contacts are in their open positions, they are spaced above a pair of stationary contacts 35 in the lower compartment 30. When the contacts 33 are closed, each engages one of the contacts 35 to establish an electrical circuit between a terminal 37 and a terminal 38. The terminals 37 are connected electrically to the mounting bases 34 while the terminals 38 are connected electrically to the stationary contacts 35. In the present instance, the circuit established by way of one pair of contacts 37 and 38 energizes a fan while the circuit established by way of the other set of contacts 37 and 38 energizes a lamp.

The contacts 33 are adapted to be pivoted between their open and closed positions in response to the rocking of a switch actuator 40. Herein, the actuator 40 includes a pair of generally cylindrical shank portions 41 whose lower ends are located in the lower compartment 30 in engagement with the switch contacts 33. The shanks 41 extend upwardly into the upper compartment 21 through an opening 42 (FIG. 1) in the bottom wall 20 and are joined integrally to the lower side of a manually operable actuator button 43 made of plastic and forming the upper portion of the actuator 40. Trunnions 44 project from the sides of the button and are received pivotally in holes 45 (FIG. 4) formed in the side walls 18 of the upper housing component 15. When the button 43 is rocked pivotally from the position shown in FIG. 1 to the position shown in FIG. 3, the shanks 41 ride across the switch contacts 33 and force those contacts downwardly into engagement with the stationary contacts 35. The contacts 33 automatically spring upwardly away from the contacts 35 when the button 43 is rocked reversely from the position shown in FIG. 3 to the position shown in FIG. 1.

It is important that any water or other liquid that might be spilled on the range panel 11 in the vicinity of the switch assembly 10 not be permitted to flow into the lower compartment 30. Any liquid in the lower compartment might bridge across the contacts 33 and 35 and cause the switch assembly to short out.

According to the present invention, the actuator 40 is sealed with respect to the lower compartment 30 in order to prevent liquid from flowing downwardly into the lower compartment and, in addition, provision is made to drain liquid from the upper compartment 21. By virtue of draining liquid from the upper compartment 21, the danger of liquid leaking around the actuator seal and into the lower compartment 30 is significantly reduced.

In the present instance, the seal between the lower compartment 30 and the actuator 40 is formed by a gasket 50 made of resiliently yieldable material such as synthetic rubber. The gasket includes a flat peripheral portion 51 which is sandwiched tightly between the lower side of the bottom wall 20 of the upper housing component 15 and the upper lip 31 of the lower housing component 25. As a result, the joint between the two housing components 15 and 28 is sealed tightly around the entire periphery of the bottom wall 20 and the lip 31 so as to prevent liquid from entering the lower compartment 30 from outside of the switch assembly 10. Part of the hole 42 through the bottom wall 20 also is covered by the flat portion 51 of the gasket 50.

A hollow block-like member 55 (FIG. 4) is molded integrally with and projects upwardly from the center of the flat portion 51 of the gasket 50 and extends upwardly through the hole 42 in the bottom wall 20. Two holes 56 are formed in the block 55 and receive the shanks 41 of the actuator 40. The shanks are telescoped into the holes and are gripped tightly by the resilient material which defines the walls of the holes. As a result, a seal is established between the shanks and the gasket 50 to keep liquid from leaking into the lower compartment 30 along the outer sides of the shanks. Because the hollow block 55 of the gasket 50 is resilient, it permits the shanks 41 to rock between the positions shown in FIGS. 1 and 3.

As shown in FIG. 1, the block 55 terminates adjacent the upper ends of the shanks 41 at an elevation indicated as "A". This is the most highly critical joint or seal area between the shanks and the gasket 50. If a good seal is not established at that elevation or if liquid is permitted to rise to and accumulate at that elevation, leakage along the shanks and into the lower compartment 30 can occur.

In carrying out the invention, liquid spilling into the upper compartment 21 is quickly drained therefrom and is prevented from rising in the upper compartment to the critical level "A". For this purpose, drain openings 60 (FIG. 4) are formed in the upper housing component 15 and allow liquid in the upper compartment 21 to drain out of that compartment to the outer side of the switch assembly 10. While the number of drain openings may vary, the upper housing component 15 of the present switch assembly 10 is formed with two drain openings located at diametrically opposite corners of the upper compartment 21. Each opening 60 extends through part of the adjacent side wall 18, extends through part of the adjacent end wall 19 and has its lower end at the same elevation as the upper surface of the bottom wall 20. By virtue of the openings, liquid is prevented from accumulating in the upper compartment 21 and thus is prevented from rising to the critical level "A".

Figure 2:
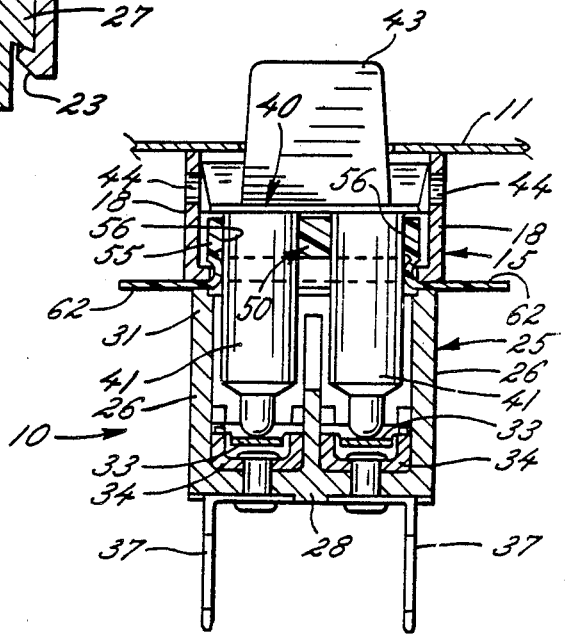
FIG. 2 is a fragmentary cross-section taken substantially along the line 2—2 of FIG. 1.

Advantageously, the gasket 50 includes fin portions 62 (FIG. 2) which project horizontally outwardly from the joints between the side walls 18 of the upper housing component 15 and the side walls 26 of the lower housing component 25. The fins 62 underlie those portions of the drain openings 60 formed through the side walls 18. As a result, liquid flowing outwardly through those portions of the drain openings is deflected outwardly by the fins. Thus, the fins serve as umbrellas to shield the joints between the side walls 18 and 26 and to prevent the liquid draining from the openings 60 from flowing into the lower compartment 30 through such joints. The legs 22 shield the outer side of the joints between the end walls 19 of the upper housing component 15 and the end walls 27 of the lower housing component 25 and thus there is no need for gasket fins for shielding the latter joints.

Means are provided on the actuator button 43 for directing spilled liquid toward the drain openings 60. Herein, these means comprise wings 65 (FIG. 4) which project in opposite directions from the lower portions of the long side margins of the button 43. Each wing 65 is shaped generally as an inverted V having an apex located at the longitudinal center of the button. Liquid spilled onto the actuator 40 is directed by the wings 65 to the ends of the upper compartment 21 for flow through the drain holes 60. Thus, the likelihood of liquid accumulating in the vicinity of the shanks 41 is reduced even further since spilled liquid is immediately directed toward the drain openings by the wings 65.

From the foregoing, it will be apparent that the present invention brings to the art a new and improved switch assembly 10 in which the drain openings 60 reduce the danger of liquid leaking past the gasket 50 and into the lower compartment 30 where the switch contacts 33 and 35 are housed. Thus, there is less danger of the switch assembly shorting out than is the case with prior switch assemblies of the same general type.

We claim:

1. A switch assembly comprising a housing, said housing having a generally horizontal wall which divides the housing into upper and lower compartments and defines an access opening between the compartments, a switch actuator having an upper portion disposed in said upper compartment and having a lower portion extending through said wall access opening and projecting into said lower compartment, a switch contact disposed in said lower compartment, said actuator being movable between first and second positions and being operable when so moved to change the electrical state of said switch contact, a resiliently yieldable gasket on said wall for sealing around said actuator adjacent said wall while permitting said actuator to move between said positions, said gasket having a sealing portion extending upwardly from said wall and contacting said actuator at a critical joint area spaced above said wall, a plurality of drain openings extending through said housing and communicating with said upper compartment while being isolated from said lower compartment, said openings being located so as to drain liquid from said upper compartment and prevent such liquid from rising to the level of said joint area and leaking downwardly into said lower compartment, said actuator upper portion having a raised central portion which may be manually engaged to move said actuator between said positions, and said actuator upper portion having wings on opposite sides of said raised central portion each shaped generally as an inverted V so as to promote the drainage of liquid downwardly off of said actuator and towards said drain openings.

2. A switch assembly as defined in claim 1 in which said plurality of drain openings extend horizontally through said housing.

3. A switch assembly as defined in claim 1 in which said housing includes an upper component and a lower component, said wall being part of said upper component, said lower component being connected to said upper component and having an upper end portion spaced downwardly from a lower side of said wall, said gasket having a relatively flat portion sandwiched between the lower side of said wall and the upper end of said lower component so as to establish a seal between said wall and said lower component.

4. A switch assembly as defined in claim 3 in which said gasket includes a fin which projects outwardly from said housing, said fin underlying said drain openings and shielding the lower component of said housing from liquid draining out of said openings.

5. A switch assembly as defined in claim 3 in which the upper portion of said actuator includes a generally cylindrical section which projects downwardly through said wall, the sealing portion of said gasket comprising a sealing member projecting upwardly from the flat portion of said gasket, said sealing member being disposed about and resiliently gripping the cylindrical section of said actuator.

6. A switch assembly comprising a housing having a upper component defining an upper compartment and having a lower compartment defining a lower compartment wherein the lower component has an outer periphery one of said components having a generally horizontal wall having an access opening, the other of said components having a sealing lip, said components being connected together with said wall and said sealing lip located in vertically spaced relation and with said wall serving to separate said upper compartment from said lower compartment and to define an access opening between said components, a switch actuator having an upper portion located in said upper compartment and having a generally cylindrical portion extending downwardly through said access opening and into said lower compartment, a switch contact disposed in said lower compartment, said actuator being movable between first and second positions and being operable when so moved to change the electrical state of said switch contact, a resiliently yieldable gasket having a flat portion sandwiched between said wall and said sealing lip to establish a seal between the two components of said housing, said gasket having an upwardly extending sealing member in sealing contact about the cylindrical portion of said actuator, on upper end of said sealing member being spaced above said wall, at least one drain opening extending horizontally through the upper component of said housing and communicating with said upper compartment while being isolated from said lower compartment, said opening being located so as to drain liquid from said upper compartment and to prevent such liquid from rising to the level of the upper end of said sealing member and leaking downwardly into said lower compartment, and said gasket including horizontal fins formed integrally with the flat portion of said gasket and projecting in cantilever fashion outwardly an appreciable distance beyond the outer periphery of said lower component of said housing in underlying relation to said drain opening for shielding the lower component of said housing from liquid draining out of said opening and for directing the liquid draining out of said opening in outwardly spaced relation to said lower housing compartment.

7. A switch assembly as defined in claim 6 in which said wall forms part of the upper component of said housing while said sealing lip defines an upper end of the lower component of said housing.

8. A switch assembly as defined in claim 6 in which a plurality of drain openings extend horizontally through the upper component.

9. A switch assembly as defined in claim 6 in which said upper compartment is generally rectangular, said drain openings being located at diagonally opposite corners of said upper compartment.

10. A switch assembly comprising a housing having a upper component defining an upper compartment and having a lower compartment defining a lower compartment wherein the lower component has an outer periphery, one of said components having a generally horizontal wall having an access opening, the other of said components having a sealing end, said components being connected together with said wall and said sealing end located in vertically spaced relation and with said wall serving to separate said upper compartment from said lower compartment and define an access opening between said components, a switch actuator having an upper portion located in said upper compartment and having a lower portion extending downwardly through said access opening and into said lower compartment, said actuator being movable between first and second positions and being operable when so moved to change the electrical state of said switch contact, a resiliently yieldable gasket having a flat portion sandwiched between said wall and said sealing end to establish a seal between the two components of said housing, said gasket having an upwardly extending sealing member in sealing contact about said actuator with an upper end of said sealing member being spaced above said wall, at least one drain opening extending through the upper of said housing and communicating with said upper compartment while being isolated from said lower compartment, said opening being located so as to drain liquid from rising to the level of the upper end of said sealing member and leaking downwardly into said lower compartment, and said gasket flat portion projecting in cantilever fashion outwardly an appreciable distance beyond the outer periphery of said lower component of said housing in underlying relation to said drain opening for shielding the lower component of said housing from liquid draining out of said opening and for directing the liquid draining out of said opening in outwardly spaced relation to said lower housing compartment.

11. A switch assembly as to find in claim 10 in which said flat portion has a uniform thickness.

* * * * *

UNITED STATES PATENT AND TRADEMARK OFFICE

CERTIFICATE OF CORRECTION

PATENT NO. : 4,937,407

DATED : June 26, 1990

INVENTOR(S) : Thomas Osika and John Stuhlmacher

It is certified that error appears in the above-identified patent and that said Letters Patent is hereby corrected as shown below:

On the face of the patent the inventors should be listed as -- Thomas Osika, Valparaiso, Ind. and John Stuhlmacher, Crown Point, Ind. --

Col. 5, line 39, "a" (second occurrence) should be -- an --.

Col. 5, line 63, "on" should be -- an --.

Signed and Sealed this

Fifteenth Day of October, 1991

*Attest:*

HARRY F. MANBECK, JR.

*Attesting Officer*

*Commissioner of Patents and Trademarks*